US010501890B2

(12) United States Patent
Heiskanen et al.

(10) Patent No.: US 10,501,890 B2
(45) Date of Patent: Dec. 10, 2019

(54) FLEXIBLE MICROFIBRILLATED FILM FORMATION

(71) Applicant: Stora Enso OYJ, Helsinki (FI)

(72) Inventors: Isto Heiskanen, Imatra (FI); Kaj Backfolk, Lappeenranta (FI); Katja Lyytikainen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 10 days.

(21) Appl. No.: 15/754,692

(22) PCT Filed: Sep. 16, 2016

(86) PCT No.: PCT/IB2016/055522

§ 371 (c)(1),
(2) Date: Feb. 23, 2018

(87) PCT Pub. No.: WO2017/046749

PCT Pub. Date: Mar. 23, 2017

(65) Prior Publication Data

US 2018/0245286 A1 Aug. 30, 2018

(30) Foreign Application Priority Data

Sep. 17, 2015 (SE) ..... 1551196

(51) Int. Cl.
*D21H 11/18* (2006.01)
*D21H 27/30* (2006.01)

(52) U.S. Cl.
CPC ..... *D21H 11/18* (2013.01); *D21H 27/30* (2013.01)

(58) Field of Classification Search
CPC ..... D21H 11/18; D21H 27/30; D21H 21/56; D21H 21/06; D21H 21/16; D21H 21/24; D21H 27/38; B32B 27/10; B32B 29/00; B32B 2307/7244; D21F 11/002; B29D 7/01; B82Y 30/00
See application file for complete search history.

(56) References Cited

U.S. PATENT DOCUMENTS 4,486,475 A 12/1984 Shutov et al.
2008/0223360 A1 9/2008 Kingma et al.
2010/0024998 A1* 2/2010 Wildlock ..... D21H 11/18 162/124
2010/0065236 A1 3/2010 Henriksson et al.
2012/0216718 A1* 8/2012 Berglund ..... D21H 11/18 106/487
2012/0219816 A1* 8/2012 Heiskanen ..... D21H 19/34 428/535
2012/0241114 A1* 9/2012 Axrup ..... D21H 17/28 162/127
2012/0251818 A1* 10/2012 Axrup ..... B32B 27/10 428/326
2015/0315747 A1* 11/2015 Heiskanen ..... D21H 11/18 162/181.2
2015/0330023 A1* 11/2015 Hillebrand ..... D21C 9/18 162/9
2016/0016717 A1* 1/2016 Toubeau ..... B01D 39/1607 220/62.13
2017/0260694 A1* 9/2017 Torniainen ..... D21F 11/002
2018/0245286 A1* 8/2018 Heiskanen ..... D21H 11/18
2018/0245287 A1* 8/2018 Heiskanen ..... D21H 11/18
2018/0355557 A1* 12/2018 Heiskanen ..... C08L 1/02
2019/0024318 A1* 1/2019 Backfolk ..... D21H 17/375
2019/0024320 A1* 1/2019 Hakansson ..... D21H 17/25
2019/0048527 A1* 2/2019 Heiskanen ..... B29D 7/01
2019/0091982 A1* 3/2019 Heiskanen ..... B29C 48/08

FOREIGN PATENT DOCUMENTS

CA 2994388 A1 * 3/2017 ..... D21H 27/30
WO 2009112255 A1 9/2009
WO 2013160553 A1 10/2013
WO WO-2013160553 A1 * 10/2013 ..... D21H 11/18
WO 2013188739 12/2013
WO 2014072913 A1 5/2014
WO WO-2017046749 A1 * 3/2017 ..... D21H 27/30

OTHER PUBLICATIONS

Freeness Conversion table.
Gabrielli, C.P. Et al. "Phenol-formaldehyde impregnation of densified wood for improved dimensional stability".
O'Connor, J.P. "Improving Wood Strenght and Stiffness through Viscoelastic Thermal Compression".
International Search Report for PCT/IB2016/055522, dated Jan. 4, 2017.

* cited by examiner

*Primary Examiner* — Jose A Fortuna
(74) *Attorney, Agent, or Firm* — Greer, Burns & Crain, Ltd

(57) ABSTRACT

A method of manufacturing a film comprising microfibrillated cellulose, wherein the method comprises the steps of: providing a first suspension comprising microfibrillated cellulose, having a dry content of from 0.2 to 2.0%, wherein the first suspension has a first Schopper-Riegler (SR) value; forming a first web of said suspension; at least partly dewatering said first web; applying a second suspension comprising microfibrillated cellulose, and/or fines and/or fibers onto a surface of said formed and at least partially dried first web, wherein the second suspension has a second Schopper-Riegler value which is higher than said first Schopper-Riegler value, thereby forming a film.

22 Claims, No Drawings

FLEXIBLE MICROFIBRILLATED FILM FORMATION

This application is a U.S. National Stage under 35 U.S.C. § 371 of International Application No. PCT/IB2016/055522, filed Sep. 16, 2016, which claims priority to Swedish patent application no. 1551196-7, filed Sep. 17, 2015.

TECHNICAL FIELD

The present document relates to the manufacture of a thin paper film, having increased barrier properties.

BACKGROUND

It is known from prior art that thin webs and films can be made from microfibrillated cellulose (MFC). The term thin film is meant to define a film having a basis weight of less than 30 g/m$^2$. This can be accomplished by either applying MFC on a plastic substrate or by applying fibers on a wire and using vacuum suction for very long time.

At high production speeds, normally pulsating dewatering elements are used on the wire section (such as register rolls, foils, vacuum foils etc). These pulsating dewatering elements open up the formed wet web structure and allow faster dewatering—leading to higher production rate. However, this also has a negative effect on the oxygen barrier properties of the produced films and may cause pin-holes in the film.

There is thus a need for a way of manufacturing a thin MFC film on a paper or board making machine at high speeds, which film shows high oxygen barrier properties and to avoid problems with pin-holes connected with prior art solutions.

SUMMARY

It is an object of the present disclosure, to enable the manufacturing of a thin MFC film on a paper machine at high speeds, which MFC film shows high oxygen barrier properties and to avoid problems with pin-holes connected with prior art solutions.

The object is wholly or partially achieved by a method according to the appended independent claims. Embodiments are set forth in the appended dependent claims, and in the following description.

According to a first aspect, there is provided a method of manufacturing a film comprising microfibrillated cellulose, wherein the method comprises the steps of: providing a first suspension comprising microfibrillated cellulose in an amount of at least 50 weight % based on the total weight of solids of the suspension, having a dry content of from 0.2 to 2.0%, wherein the first suspension has a first Schopper-Riegler (SR) value; forming a first web of said suspension; at least partly dewatering said first web; applying a second suspension comprising microfibrillated cellulose, and/or fines and/or fibers onto a surface of said formed and at least partially dried first web, wherein the second suspension has a second Schopper-Riegler value which is higher than said first Schopper-Riegler value, thereby forming a film. By the term dry content is meant content of dry matter in the suspension based on the total weight of the suspension.

The film is preferably made by wet laid technologies, e.g. in a paper or board making machine.

It has been shown that this causes a so called "self-healing effect"—the finer (defined by a higher SR value) MFC/fines/fibers of said second suspension are concentrated to areas of the web or film where there is a hole or a weakness or a higher porosity. In subsequent dewatering steps, the flow of the materials (and water) is highest in the most porous areas of the web. Because of this flow, more material is flowing through the porous areas, and consequently, material in the flow is blocking those porous areas. The method of the invention allows films with high oxygen barrier to be produced at dramatically increased production speeds, especially increased dewatering speeds, which is usually desirable in the paper making process. This is partly due to the fact that the method of the invention enables the use of higher vacuum levels in the drying while still avoiding pick up of finer material on the wire. This method allows the use of base material that may be more efficiently dewatered, i.e. less fines in the headbox, and the use of very fine fines in areas only where they are needed. By this method it is thus possible to achieve a better total dewatering process for oxygen barrier films.

The first suspension comprises microfibrillated cellulose (MFC) in an amount of at least 50 weight %, or at least 70 weight % or above 80 weight %, based on the weight of solids of the suspension. In one embodiment, the microfibrillated cellulose content of the suspension may be in the range of 70 to 95 weight %, in the range of 70 to 90 weight %, or in the range of 70 to 90 weight %.

According to one embodiment the first suspension may further comprise a filler material in an amount of from 3 to 40 weight-%, or in an amount of from 5 to 15 weight % based on the weight of solids of the suspension.

The first suspension may further comprise long fibers in an amount from 5-50 weight %, or in an amount of from 5 to 15 weight-%, based on the weight of solids of the suspension. By "long fibers" is meant fibers in a less refined pulp, having a length of >0.8 mm.

According to one embodiment said first suspension may have a SR value in the range of from 40 to 90, or in the range of from 60 to 85.

The second suspension may further comprise any one of fines and/or short fibers, fillers materials, retention chemicals, flocculation additives, deflocculating additives, wet strength chemicals, dry strength additives, softeners, or mixtures thereof. The filler material may for instance be precipitated calcium carbonate (PCC), nano clay or nano PCC. The filler material may also comprise an organic filler, e.g. polyethylene particles or polyethylene fibers According to one embodiment said second suspension may be provided to the surface of the first web in a head-box.

The second suspension may be provided to the surface of the first web by or through a size press.

The second SR value may be from 5% to 30% higher than the first SR value.

The second suspension may further have less dry content than the first suspension. This second suspension, comprising diluted fines, can e.g. be collected from the white water of the paper machine. These collected fines can be used as they are or made more fine via fractionation or mechanical and/or chemical treatments. Separate MFC can also be produced for this purpose. The second suspension may comprise MFC, fines and/or short fibers.

The method may further comprise the step of dewatering the formed film.

The dewatering may according to one embodiment be performed by vacuum. Dewatering by use of vacuums is enabled through this invention and will cause a flow of wet fines/MFC/fibers of the second suspension to the pores in the web—thereby forming a very dense MFC film and problems with pinholes related to the formation of MFC films in the prior art is avoided. Pin holes are imperfections in the paper which appear as minute holes upon looking through the sheet.

According to another embodiment the dewatering may be performed by mechanical pressure. The mechanical pressure is used to cause the flow of wet fines/MFC/fibers of the second suspension to the holes in the web.

According to a second aspect there is provided a film obtained by the method according to the first aspect, wherein the film has an oxygen transmission rate (OTR) of less than 500 ml/m$^2$/24 h, or less than 100 ml/m$^2$/24 h, or less than 50 ml/m$^2$/24 h, or less than 10 ml/m$^2$/24 h or less than 1 ml/m$^2$/24 h.

According to a third aspect there is provided a film obtained by the method according to the first aspect, wherein the film has a basis weight of less than 50 g/m$^2$, or less than 35 g/m$^2$, less than 25 g/m$^2$, or less than 20 g/m$^2$.

DESCRIPTION OF EMBODIMENTS

According to one embodiment the film is produced or manufactured in a conventional paper making machine, such as Fourdrinier machine, which is well known to the skilled person. The film is manufactured by providing a first aqueous suspension that comprises microfibrillated cellulose fibers. This first suspension may have a Schopper-Riegler (SR) value, i.e. a first drainability, in the range of from 40 to 90, or in the range of from 60 to 85.

The Schopper-Riegler value can be obtained through the standard method defined in EN ISO 52671/1. Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., Cellulose fibres, nanofibrils and microfibrils: The morphological sequence of MFC components from a plant physiology and fibre technology point of view, Nanoscale research letters 2011, 6:417), while it is common that the aggregated form of the elementary fibrils, also defined as microfibril (Fengel, D., Ultrastructural behavior of cell wall polysaccharides, Tappi J., March 1970, Vol 53, No. 3), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber). There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 300 m2/g, such as from 1 to 200 m2/g or more preferably 50-200 m2/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated.

MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofbril (CMF) defining a cellolose nanofbire material containing multiple elementary fibrils with both crystalline and amorphous regions, having a high aspect ratio with width of 5-30 nm and aspect ratio usually greater than 50.

This first suspension may also comprise long fibers in an amount from 5-50 weight %, or in an amount of from 5 to 15 weight-%. By "long fibers" is meant fibers in a less refined pulp, having a length of >0.8 mm.

According to one embodiment the first suspension may also comprise a filler material, in an in an amount of from 3 to 40 weight-%, or in an amount of from 5 to 15 weight %. The filler may be added as a ready-made filler or added in such a manner that it is formed directly in the first suspension, e.g. be allowing to different additives to react to form the filler.

The filler material may for instance be precipitated calcium carbonate (PCC), nano clay or nano PCC.

The first suspension is then brought to a forming section, usually a porous wire of the paper making machine to form a first web. This first web may then be at least partially dewatered, through conventional dewatering techniques.

After the dewatering of the first web a second suspension having a second SR value is provided. This second SR value is higher than that of the first suspension. According to one embodiment the second SR value is from 5% to 30% higher than said first SR value.

The dry content of the second suspension may, according to one embodiment be lower than that of the first suspension. The second suspension can be a mixture of MFC, fines and short fibers. The suspension may also include filler materials, retention chemicals, flocculation additives, deflocculating additives, wet strength chemicals, dry strength additives, softeners, or mixtures thereof.

It is possible to collect the second suspension, from a white water stream of the paper machine. These collected fines can be used or further make them more fine via fractionation or mechanical and/or chemical treatments.

The filler material in the second suspension may also be for instance be precipitated calcium carbonate (PCC), nano clay or nano PCC. It can either be added as a ready-made filler or be formed directly into the aqueous suspension. The filler material may also comprise an organic filler, e.g. polyethylene particles or polyethylene fibers.

According to one embodiment the second suspensions is brought onto the (at least partially dewatered) first web in a head-box. In this embodiment, a first headbox may be used to apply the first suspension on a wire, and a second headbox arranged downstream of said first headbox, may be used to apply said second suspension onto the first web. In an alternative embodiment the second suspension is applied onto the first web by use of a size press.

By applying the second suspension to the first web a second web or film is formed.

After the provision of the second suspension to the first web, the formed second web or film may be dewatered to form a substantially dry film, or a film having a reduced water content compared to the second web or film, depending on the end use of this film.

The dewatering of both webs may be performed by vacuum. Preferably the secondly formed web or film may be dewatered by vacuum.

The dewatering may also, according to another embodiment, be performed by applying mechanical pressure, to cause the flow of wet fines/MFC/fibers of the second suspension to the holes in the web. One way of achieving this mechanical pressure is to use a size press both to add said second suspension and to accomplish the pressure causing the flow of material to the holes.

Additional dewatering may further be performed by conventional dewatering techniques, including also chemical dewatering, drying and/or evaporation.

The self-healing treatment of the invention can be done on both sides of the web formed, i.e. a second suspension with an SR value higher than the first suspension may be applied onto both a first and a second surface of the web.

Through this method a film can be formed that has a noticeably decreased oxygen transmission rate (OTR), i.e. increased barrier properties, compared to conventionally wet laid papers, yet being very thin. The thin film formed according to the above described method may have a basis weight of less than 50 g/m$^2$, or less than 35 g/m$^2$, less than 25 g/m$^2$, or less than 20 g/m$^2$. The film has preferably a thickness of below 50 μm, or below 40 μm, or below 35 μm, most preferably in the range of 20-40 μm.

The OTR value was measured in accordance with the standard ASTM D3985-05. This standard is applicable both to the definitions of the appended claims and to the measurements performed in the example below. The measurement was done at 23 C and at 0% RH.

The porosity of this film may be so low that neither a Bendtsen value nor a Gurley Hill value can even be measured, i.e. comparable to coated paper grades.

EXAMPLE 1

In an example a microfibrillated cellulose film was produced the wire section of on a conventional paper making machine. In a reference test (ref), water was added in the size press. Two tests in accordance with one embodiment of the invention were conducted with different concentrations of MFC added in the size press:

| | Reference | Test 1 | Test 2 |
|---|---|---|---|
| Size press addition | Only water | MFC concentration 0.1 g/m2 | MFC with concentration 0.4 g/m2 |
| OTR | 16800 | 1400 | 125 |

From the trial it is evident that, the oxygen barrier properties, defined by the oxygen transmission rate (OTR) being greatly reduced, i.e. were improved, by the addition of a second suspension of MFC in the size press.

EXAMPLE 2

In another example, webs of 15 gsm were formed from furnish comprising microfibrillated fibers in an amount of 100 weight % based on the total solid content of the furnish. Said furnish having an SR value of 23.5.

Various amounts (0-8 gsm) of suspensions comprising fine MFC, with SR value of above 90 were applied on top of the wet, partly dewatered webs.

| Fine MFC [g/m$^2$] (theoretical) | Fine MFC [g/m$^2$] (based on grammage difference | Film grammage [g/m$^2$] | Thickness [μm] | Density [kg/m$^2$ | OTR [cc/(m$^2$-24 h)] |
|---|---|---|---|---|---|
| 0 | — | 16.8 | 25.5 | 661 | 1947 |
| 2 | 2.4 | 19.2 | 27.5 | 699 | 13 |
| 4 | 4.6 | 21.4 | 28.4 | 754 | 15 |
| 6 | 6.7 | 23.5 | 30.0 | 783 | 12 |
| 8 | 8.8 | 25.6 | 31.6 | 842 | 12 |

The OTR for the reference film (0 gsm fine MFC) and the films made according to the inventions were measured in accordance with the standard ASTM D3985-05 (Table 1). As can be seen in Table 1, the OTR value is highly reduced by the addition of fine MFC with a higher SR value ontop of the web formed from fibers with lower SR value.

The invention claimed is:

1. A method of manufacturing a film comprising microfibrillated cellulose, wherein the method comprises the steps of:

providing a first suspension comprising microfibrillated cellulose in an amount of at least 50 weight % based on the total weight of solids of the suspension, having a dry content of from 0.2 to 2.0%, wherein the first suspension has a first Schopper-Riegler (SR) value;

forming a first web of said suspension;

at least partly dewatering said first web;

applying a second suspension comprising microfibrillated cellulose onto a surface of said formed and at least partially dewatered first web, wherein the second suspension has a second Schopper-Riegler value which is higher than said first Schopper-Riegler value; and, forming a film after the second suspension has been applied to said formed and at least partially dewatered first web.

2. The method as claimed in claim 1, wherein said first suspension further comprises a filler material in an amount of from 3 to 40 weight %, based on the total weight of solids of the suspension.

3. The method as claimed in claim 1, wherein said first suspension further comprises fibers in an amount from 5-50 weight %, based on the total weight of solids of the suspension.

4. The method as claimed in claim 1, wherein said first suspension has a SR value in the range of from 40 to 90.

5. The method as claimed in claim 1, wherein said second suspension further comprises at least one from a group consisting of: fines, fibers, fillers materials, retention chemicals, flocculation additives, deflocculating additives, wet strength chemicals, dry strength additives, softeners, or mixtures thereof.

6. The method as claimed in claim 1, wherein said second suspension is provided to the surface of the first web in a head-box.

7. The method as claimed in claim 1, wherein said second suspension is provided to the surface of the first web by a size press.

8. The method as claimed in claim 1, wherein said second SR value is from 5% to 30% higher than said first SR value.

9. The method as claimed in claim 1, wherein said second suspension has less dry content than the first suspension.

10. The method as claimed in claim 1, wherein said second suspension is applied to the surface of the first web in the form of foam.

11. The method as claimed in claim 1, wherein the method further comprises the step of dewatering the formed film.

12. The method as claimed in claim 11, wherein the dewatering is performed by vacuum.

13. The method as claimed claim 11, wherein the dewatering is performed by mechanical pressure.

14. A film obtained by the method as claimed in claim 1, wherein the film has an oxygen transmission rate (OTR) of less than 500 $ml/m^2/24$ h.

15. A film obtained by the method as claimed in claim 1, wherein the film has a basis weight of less than 50 $g/m^2$.

16. The method as claimed in claim 1, wherein said first suspension further comprises a filler material in an amount of from 5 to 15 weight %, based on the total weight of solids of the suspension.

17. The method as claimed in claim 1, wherein said first suspension further comprises long fibers in an amount of from 5 to 15 weight %, based on the total weight of solids of the suspension.

18. The method as claimed in claim 1, wherein said first suspension has a SR value in the range of from 60 to 85.

19. A film obtained by the method as claimed in claim 1, wherein the film has an oxygen transmission rate (OTR) of less than 50 $ml/m^2/24$ h.

20. A film obtained by the method as claimed in claim 1, wherein the film has an oxygen transmission rate (OTR) of less than 1 $ml/m^2/24$ h.

21. A film obtained by the method as claimed in claim 1, wherein the film has a basis weight of less than 35 $g/m^2$.

22. A film obtained by the method as claimed in claim 1, wherein the film has a basis weight of less than 20 $g/m^2$.

* * * * *